US005195684A

United States Patent [19]

Radzins

[11] Patent Number: 5,195,684

[45] Date of Patent: Mar. 23, 1993

[54] SCREENLESS DISK MILL

[75] Inventor: Edmund Radzins, Boynton Beach, Fla.

[73] Assignee: Curt G. Joa, Inc., Boynton Beach, Fla.

[21] Appl. No.: 879,784

[22] Filed: May 6, 1992

[51] Int. Cl.[5] ..... B02C 7/02; D21B 1/00

[52] U.S. Cl. ..... 241/57; 241/152.2; 241/188.1; 241/242; 241/261.1; 241/294

[58] Field of Search ..... 241/57, 152.2, 188.1, 241/261.1, 261.2, 261.3, 294, 242

[56] References Cited

U.S. PATENT DOCUMENTS

| | | | |
|---|---|---|---|
| 745 | 6/1859 | Kingsland, Jr. | 241/261.2 |
| 3,538,551 | 11/1970 | Joa | 19/83 |
| 3,661,329 | 5/1972 | Smith et al. | 241/28 |
| 3,815,835 | 6/1974 | Apostol et al. | 241/188.2 |
| 4,383,650 | 5/1983 | Contal et al. | 241/261.3 X |
| 5,040,736 | 8/1991 | Obitz | 241/261.3 X |

FOREIGN PATENT DOCUMENTS

| | | | |
|---|---|---|---|
| 1190078 | 7/1985 | Canada . | |
| 1528380 | 12/1989 | U.S.S.R. | 241/152 A |

*Primary Examiner*—Frank T. Yost

*Assistant Examiner*—Clark F. Dexter

*Attorney, Agent, or Firm*—Fuller, Ryan, Hohenfeldt & Kees

[57] ABSTRACT

The circular housing of a fiberizer mill has a rotationally driven shaft on which there is a disk haivng a conical face and spaced apart rows of teeth. A stationary disk has on its face a multiplicity of annular grooves which define teeth. There is a small gap between the tips of the rotary teeth and the tips of the stationary teeth. The gap extends at an acute angle relative to vertical plane passing perpendicular to the shaft axis so that particles being disintegrated experience a horizontal component of force. The result is that particles, after having been exploded by striking the teeth on the stationary disk, are emitted generally radially outwardly from the gap. Hammer bars on the periphery of the rotary disk are surrounded by a toothed circular breaker plate member concentric to the orbital path of the hammers on the rotary disk. The flow of fibers and particles outwardly of the gap between the rotary and stationary disks continues into the path of the hammers which smash the particles against the teeth of the circular breaker plate. The plate has a gap in it through which the air entrained fibers are passed to an outlet.

12 Claims, 5 Drawing Sheets

SCREENLESS DISK MILL

BACKGROUND OF THE INVENTION

The invention disclosed herein pertains to a mill for reducing sheets of wood pulp to discrete fibers. One use of such fibers is as absorbent material in disposable diapers, sanitary napkins and the like.

All of the fibers in pulp sheets are not full length. Short fibers are characterized as dust or fines. The pulp sheets of some makers have a larger percentage of fines than others.

One of the problems with prior or pre-existing mills is that they break down an additional substantial percentage of the fibers into dust or fines. Long fibers are more absorbent which is desirable. Fines do not hold liquid.

Fines production in known mills has been determined to be largely due to the manner in which the gross particles of pulp are broken down into discrete fibers. The commonly used procedure is to subject the pulp particles to a shearing action. Bladelike members interleaved with each other as they move relative to each other as shears have a tendency to repeatedly shear the fibers to a shorter length which is well known to impair absorption. Known mills that comminute dry pulp particles into fibers have forced the fibers through a screen immediately before they are discharged from the mill. Forcing the fibers through a screen has a tendency to break down the fibers even more whereby to increase fines production. Equally important from the economic point of view is that forcing fibers through a screen requires power which means that the power consumed by such mills is inordinately high.

A mill over which the new mill disclosed herein is an improvement, is described in Canadian Patent No. 1,190,078, dated Jul 9, 1985. This mill is comprised of an involute-shaped housing similar to the housing of a centrifugal fan. A flat faced rotary disk is arranged concentrically with the interior of the housing. The face of the disk has radially extending and angularly spaced apart rows of cutter teeth on it. There is a pulp sheet infeed slot in one side of the housing toward which these cutter teeth project. As the pulp sheet is fed through the slot, its leading edge is pushed into the rotating cutter teeth which initiates breaking the pulp sheet into particles. The periphery of the rotating disk has hammers or wipers on it. There is a short segment concentric to the rotational path of the hammers which has teeth on it that cooperate with the hammers or wipers to break down the pulp particles. Any given pulp particle can experience several orbits around the interior of the housing before being fully comminuted into fibers such as to allow it to pass through a screen which extends over the periphery of about 180° of the rotating disk. The screen assures that no large particles will be discharged from the mill but the perforations in the screen have a propensity to plug or reduce their size at least so that a considerable amount of energy is required to force the fibers through the screen along an involute channel to an outlet. In the patented mill the rows of cutters on the face of the rotary disk act somewhat like fan blades which drive the particles and fibers radially outwardly toward the curved breaker plate segment without very much action taking place on the particles while they are in transit to the breaker plate or the screen. Thus, throughput of the mill is not optimized.

Another known fiberizer mill is described in U.S. Pat. No. 3,815,835, dated Jun. 11, 1974. This mill has a rotating disk which is conical. In other words, its face is beveled radially outwardly from its center so that it is thinner at the periphery than at the center. There is a mosaic of axially extending prongs or cutters projecting from the face of the disk. A substantially corresponding number of stationary cutters or teeth project from a wall of the housing of the mill and they intermesh or interdigitate with the cutters projecting from the rotary disk such that particles captured between the clearance spaces between the rotary and stationary cutters or teeth are sheared as they advance radially outwardly toward an outlet in the housing. The objective of the patented mill is to produce the finest possible particles as is described in the patent. The patented device would be inappropriate for reducing dry pulp to its constituent fibers because the mill is designed for producing extremely fine particles which would be characterized as waste dust or fines in the pulp fiberizing art.

Another type of fiberizer is disclosed in U.S. Pat. No. 3,538,551. In one embodiment a rotary disk having a frusto conical face is used. The face has a multiplicity of axially extending needles against which the edge of a pulp sheet is fed. The needles disintegrated the pulp into fibers. The rotary frusto conical disk does not cooperate with a stationary conical disk as in the present invention.

SUMMARY OF THE INVENTION

In accordance with the invention, a circular or ringlike breaker plate is arranged within a housing such that the axially opposite ends of the breaker plate are interfacing with and are closed by the walls of the housing. There is a circumferentially extending short gap in the breaker plate to provide for passing fibers from inside of the breaker plate to an outlet in the housing. A rotary disk having a truncated cone configuration rotates concentrically within the interior of the substantially circular breaker plate. The exterior face or conical surface of the rotary cone is shaped complementarily to a stationary cone such that it may be said one cone nests or recesses in the other. The stationary cone has on its face a plurality of concentric grooves which define annular teeth. One side of each tooth is flat and lies on a radius of curvature of the rotary cone. The housing and the stationary toothed disk are slotted to provide a means for feeding dry pulp sheets into the housing. The rotary disk has radially extending rows of teeth on it and the leading edge of the pulp sheet is chewed off by those teeth as the rotor rotates. The angle of the face of the stationary cone and the angulation of the teeth on it are so designed that the particles of pulp which are initially broken off are impelled radially outwardly so they are repeatedly disintegrated or comminuted by impacting the teeth on the stationary disk while they are in transit. After having experienced a substantial disintegration, the fiber particles and any larger particles are impelled into the toothed breaker plate where they are further disintegrated by impacting against one side of the slanted breaker plate teeth. The one side of the breaker plate teeth if extrapolated would lie on radii passing through the center of rotation of the rotary disk. Thus, the process of disintegrating the pulp particles from the moment they are chewed off by the teeth on the rotating disk is by impact against the one side of the teeth which explodes the particles without subjecting them to any shearing action.

Accordingly, the new fiberizer mill achieves the objectives of breaking down dry pulp into fibers that are near their original length by impacting rather than shearing such that the production of a percentage of dust or fines is reduced below anything heretofore achieved in a fiberizer mill.

Another important objective that is achieved is the capability of the new mill to avoid the use of a screen through which the fibers must pass before they can exit the mill housing. Avoidance of the screen contributes towards reducing dust production and makes a substantial contribution to reducing the electric power input to the fiberizer mill. In fact, the mill which will be described in detail shortly hereinafter, has been able to reduce electric power consumption by 30% or more below power consumed by known mills.

How the foregoing features and objectives and other features and objectives of the invention are achieved will be evident in the ensuing more detailed description of the invention which will now be set forth in reference to the drawings.

DESCRIPTION OF A PREFERRED EMBODIMENT

Figure 1:
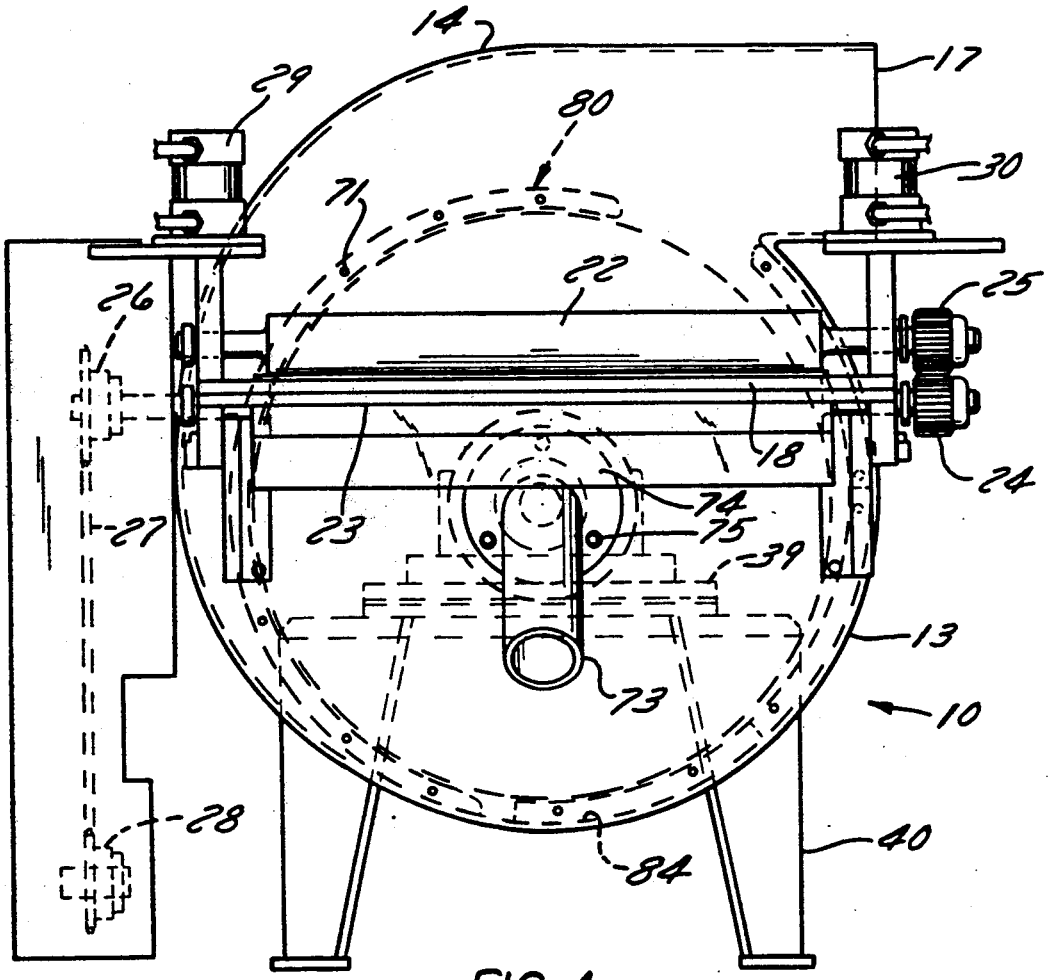
FIG. 1 is a front elevational view of the new fiberizer mill.
Figure 2:
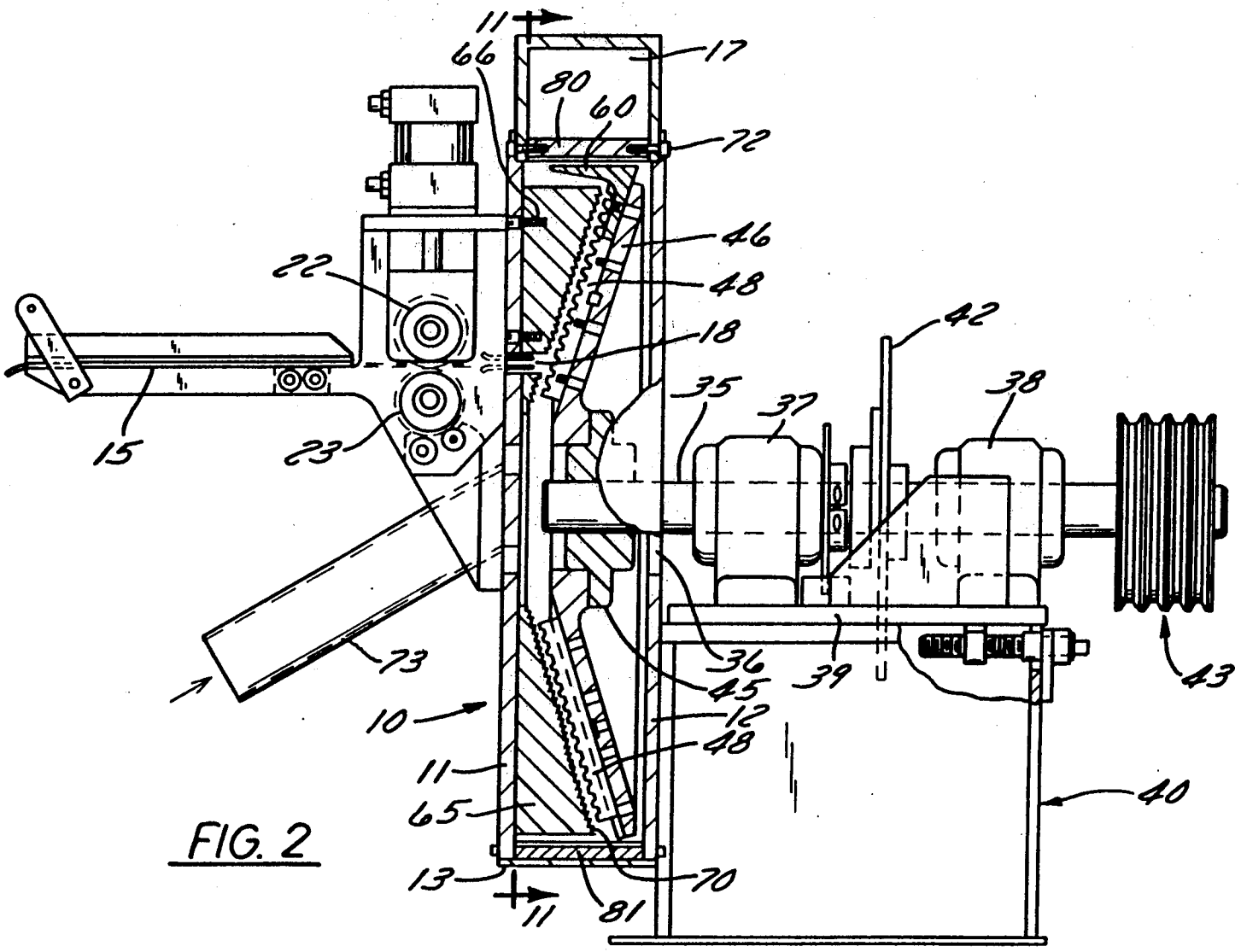
FIG. 2 is a vertical section through the center of the mill.

Referring to FIGS. 1 and 2, the fiberizer includes a housing comprised of a generally circular wall 10 that has a channel-shaped cross-section and is closed on its sides by means of a front wall 11 and a rear wall 12. In FIG. 1, one may see that from a point where the lead line from the reference numeral 13 is applied to a clockwise location where the lead line from the numeral 14 is applied, the radius of outer wall 10 of the housing increases so it has an involute shape. Actually, the housing may be identical with the housing described in the cited Canadian patent. One of the features of the invention is that the parts of the new fiberizer mill can be retrofitted into an old housing when its internal original parts wear out. Near the upper portion of FIGS. 1 and 2, one may see that the housing has an outlet 17 from which the fibers are discharged.

Figure 3:
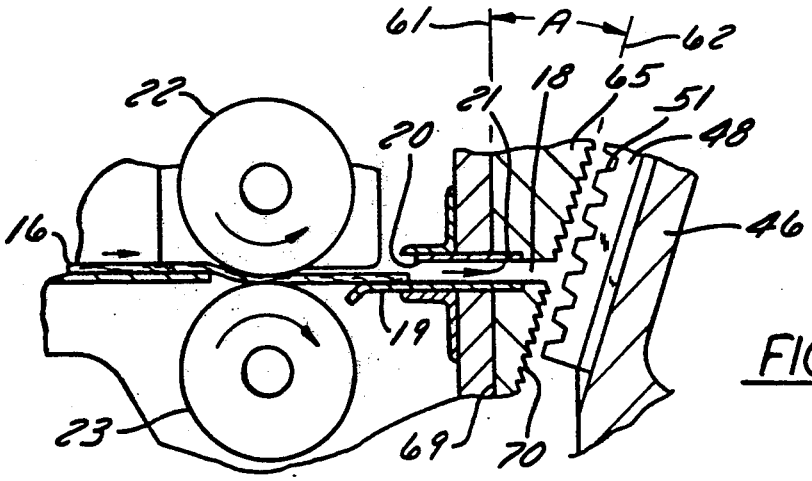
FIG. 3 is a fragmentary sectional view of a part of the fiberizer mill which is involved in advancing pulp sheets into the mill for disintegration.

As shown in FIG. 1 but most easily visualized in FIG. 2, the front wall 11 of the housing is provided with a chordal slot 18 for feeding a sheet 16 (FIG. 3) or a web of dry hard pulp into the housing for being disintegrated into its constituent wood fibers. An enlarged view of the slot 18 and associated parts is depicted in FIG. 3. FIG. 1 shows that the slot 18 is a chord of a generally circular housing and that the chord is radially displaced from the center of the housing. FIG. 3 illustrates guide plates 19 and 20 that define the slot 18 through which the sheet of pulp is fed into the housing along a plane coincident with that of the arrow 21. The pulp sheets 16 are fed to slot 18 along a table 15. A pair of driven friction rollers 22 and 23 are used for pushing and advancing the pulp sheet through the slot 18 into the housing similar to the cited Canadian Patent. Lower roller 23 is on a shaft that has a pinion 24 that engages with another pinion 25 on a shaft of roller 22. The shaft of roller 23 has a sprocket 26 on its left end as viewed in FIG. 1 for being driven with a chain 27. The chain is driven from a sprocket 28 by power derived from the shaft of a machine system, not shown. A pair of pneumatic cylinders 29 and 30 are provided for pressing upper roller 22 down in a yielding fashion to create the necessary force for driving pulp sheets of various thicknesses through slot 18 into the fiberizer.

As shown in FIG. 2, a shaft 35 extends through an air intake opening 36. The shaft 35 is journaled in two bearing blocks 37 and 38 that are mounted on a platform 39 which is mounted on a stand 40. A brake disk 42 is fastened to shaft 35. The other parts of the braking system, not shown, need not be discussed since they are simply involved in decelerating the rotating shaft 35 to a stop when occasion calls for it. The shaft is driven through the agency of a v-pulley 43 by belts, not shown, which derive power from a source that need not be described.

Figure 6:
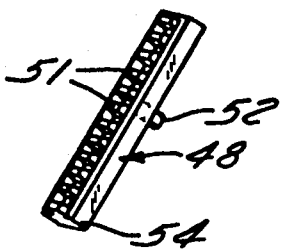
FIG. 6 is a perspective view of a toothed cutter bar removed from the rotary disk depicted in FIG. 5.
Figure 4:
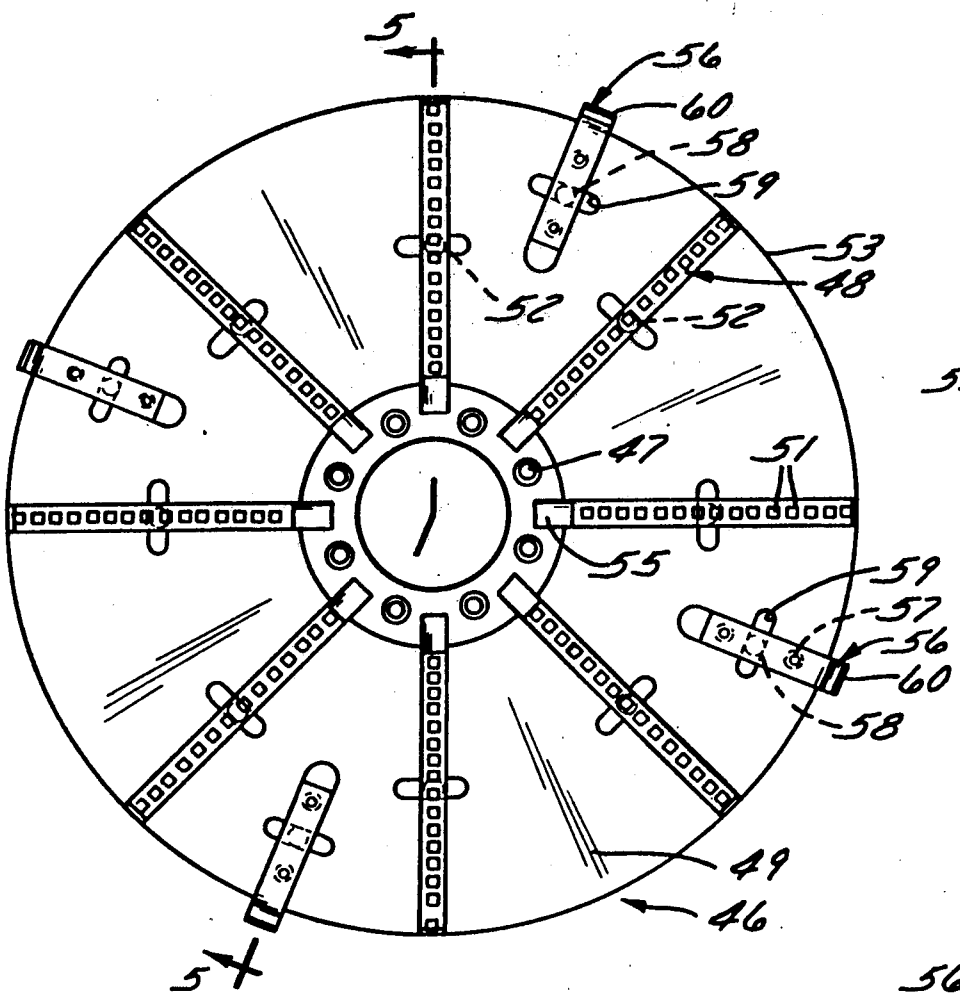
FIG. 4 is a view of the front face of a truncated conically-shaped rotary disk which operates within the housing of the mill.
Figure 10:
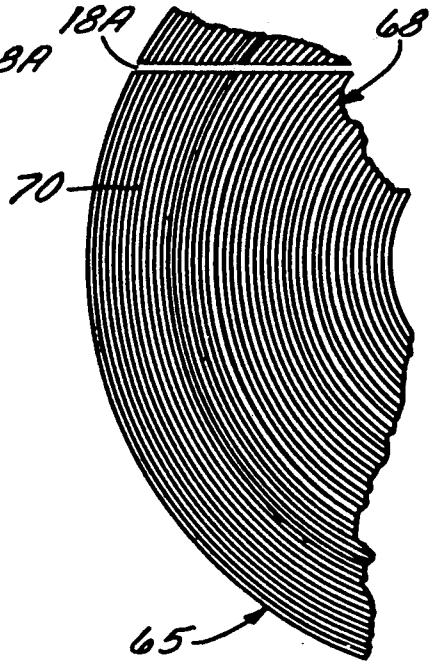
FIG. 10 is a partial view of the face of the stationary disk.

A hub 45 is fastened to shaft 35 as shown in FIG. 2. A rotary conical disk 46 is mounted to hub 45 for rotating at the rotational speed of the shaft. The face of rotary disk 34 is observable in FIG. 4. The disk has a circular arrangement of holes 47 for bolting it onto hub 45. There are rows of bars 48 arranged equiangularly about the conical front face 49 of rotary disk 46. The bolts for securing the bars to the rotary disk face are depicted in the FIG. 5 sectional view and are marked 50. The bars 48 are provided with axially protruding square teeth such as the one marked 51. In a model wherein the disk has a diameter of about 22" (56 cm), by way of example and not limitation, the teeth 51 are 5/16 inch (0.8 cm) squares. The bars are further secured against being centrifuged radially off of the face 49 of the rotary disk by the use of keyways and keys the latter of which are marked 52 in FIG. 4. Such construction is necessary since, by way of example, the disk 46 is preferably rotated at a very high speed such as 3600 rpm. In the case of a 22" (56 cm) diameter disk, this means that the linear speed of the periphery 53 of the disk would be about 22,600 feet (6900 meters) per minute or 377 feet (115 meters) per second. The toothed bars 48, which are also shown in detail in FIG. 6, have a free end 54 that, as seen in FIG. 4, fits into radial notches such as the one marked 55. This further assures that the bars 48 are stabilized on the face 49 of disk 46.

Figure 7:
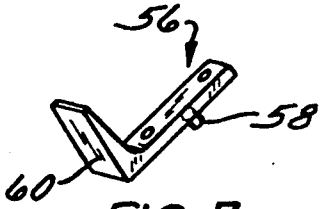
FIG. 7 is a perspective view of a hammer member which is isolated from the rotary disk depicted in FIGS. 4 and 5.
Figure 5:
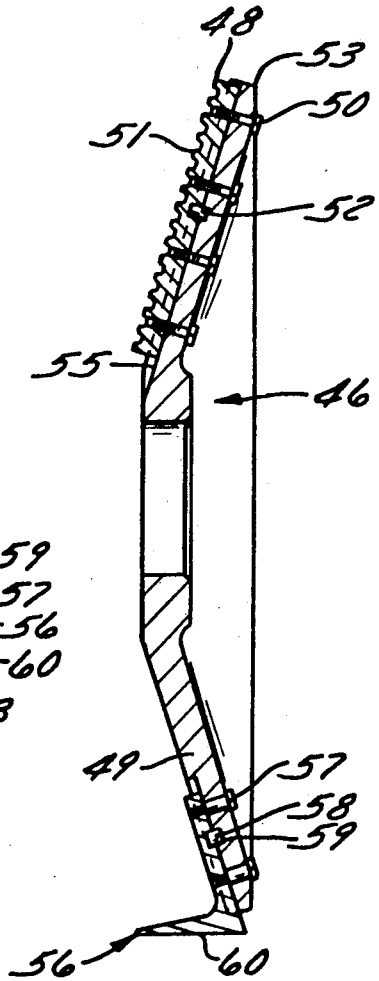
FIG. 5 is a vertical section taken along the lines corresponding to 5—5 in FIG. 4.

There are four hammer or wiper members such as the one marked 56 mounted to the face 49 of conical rotary disk 46 by means of machine screws 57 as depicted in FIGS. 4 and 5. The wipers 56, as shown in FIGS. 5 and 7 particularly well, are provided with dowel pins 58 which register in keyways 59 to further secure the hammers or wipers 56 against being centrifuged radially from the high speed rotating disk 46. The wipers or hammers have a head 60 formed on them for sweeping past the radially inside face a stationary circular breaker plate which will be identified and discussed in detail later.

Figure 9:
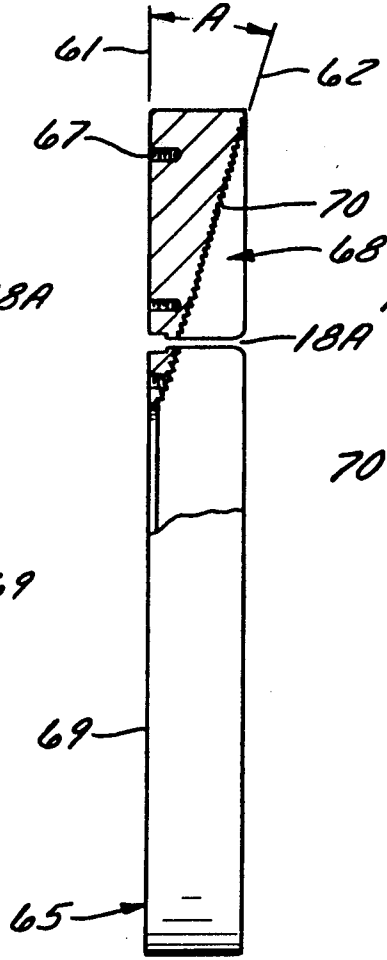
FIG. 9 is a partial vertical section taken on a line corresponding with 9—9 in FIG. 8 and showing the conical or beveled axially face of the stationary disk and the annular teeth which are defined by annular grooves in the face of the disk.
Figure 8:
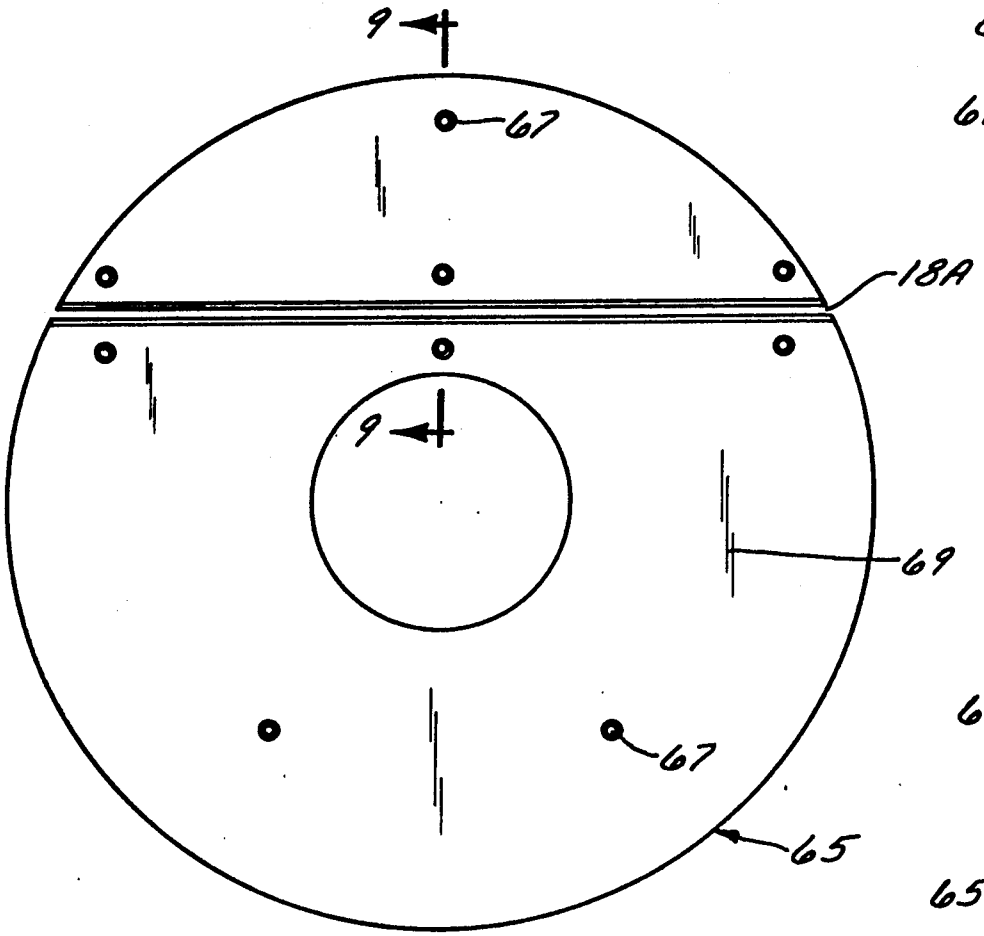
FIG. 8 is a rear view of a stationary disk which cooperates with the rotary disk within the fiberizer mill housing and contains a chordal slot through which the pulp sheets are fed into the fiberizer mill.

As can be seen in FIGS. 2, 3 and 9, a stationary conical disk 65 is mounted to front wall 11 in housing 10 face-to-face with rotary disk 46. The machine screws 66 for securing the stationary disk 65 to the wall 11 are visible in FIG. 2. The threaded holes 67 for the machine screws are visible from the back of the stationary disk 65 in FIG. 8. Disk 65 is formed initially as a solid disk faced with annular teeth as will be described but a chordal cut is taken through it to create a slot 18A which is congruent with slot 18 in housing wall 11 through which the pulp sheets are fed into the mill. The shape of the front face 68 of the stationary disk is, in a sense, the negative of the shape of the face of the rotary disk. That is, the stationary disk face 68 is complementary in shape to the face of the rotary disk 46. The rotary disk might also be characterized as being convex and the stationary disk might be characterized as being concave so that the rotary disk can nest or register in the cavity of the stationary disk and be in close proximity thereto.

The slope or angle of the face 68 of the stationary disk 65 is, by way of example and not limitation, at an angle A of about 17° relative to the vertical rear face 69 of the stationary disk as shown in FIG. 9 where the angle is shown marked off by construction lines 61 and 62. This angle is the same as the angulation of the face of the rotary disk relative to vertical. These angles should, of course, be the same. As is evident in FIGS. 2, 3, 9 and 10, the conical face 68 of the stationary disk 65 has a plurality of concentric grooves which define the surfaces of a plurality of teeth or impact surfaces 70. The sides of serrations constituting the impact surfaces are faced radially inwardly of stationary disk 65. They can be identified by referring to FIG. 3 where one of the annular impact surfaces is touched by the end of the lead line extending from numeral 70. It may also be noted that the sides 70 of the serrations are and should be perpendicular to the front plane of the disk as represented by the construction line 62 that marks off angle A in FIG. 9. Regardless of the angle A chosen by the designer, the impact sides 70 of the serrations should always be perpendicular to line 62. This fulfills the objective of having the pulp particles that are driven along the face of the disk under the influence of centrifugal force and the powerful air stream at the interface of the disks 46 and 65 impact the sides of the serrations 70 perpendicular to obtain the efficient reduction of pulp to fibers in the mill. Note the slant of one side of each annular tooth.

To distinguish the teeth 70 on the stationary conical disk 65 from teeth on other elements in the fiberizer mill, the teeth 70 will be called serrations.

It is necessary to draw air into the housing to cause the fibers to be swept radially outwardly of the rotary disk and into the outlet passageway 17. FIGS. 1 and 2 show an air intake pipe 73 which has a flange 74 to provide for fastening the pipe to the front wall 11 of the housing by means of machine screws 75. Air can also be drawn into the opening 36 through which the shaft 35 passes.

By way of example and not limitation, in a design wherein the approximate diameters of the rotary and stationary truncated disks 46 and 65, respectively, are about 23 inches (56 cm) the tips of the teeth 70 on the face of the stationary disk 65 are spaced from the tips of the teeth in the row of teeth 51 on the bars 48 of the rotary disk by about 0.1 of an inch (0.025 mm), for example. There is no intermeshing of the teeth on the rotary disk and the serrations or teeth on stationary disks. It should be understood also that the stationary conical disk 65 and rotary conical disk 46 could be formed conversely. That is, the stationary disk could be formed with a convex conical face and the rotary disk could be formed with a complementarily shaped concave face so that the fibers would still be propelled along a radially angulated gap between the tips of the teeth on the two disks. Having the conical face of one disk shaped complementarily to the face of the other conical disk and having the two disk surfaces defining a thin angular passageway or gap between the teeth of the disks, results in the development of a horizontal component of motion for particles between the disks which drives the particles so they impact and explode or disintegrate against the sides of the serrations 70 on the face 68 of the stationary disk 65.

Figure 11:
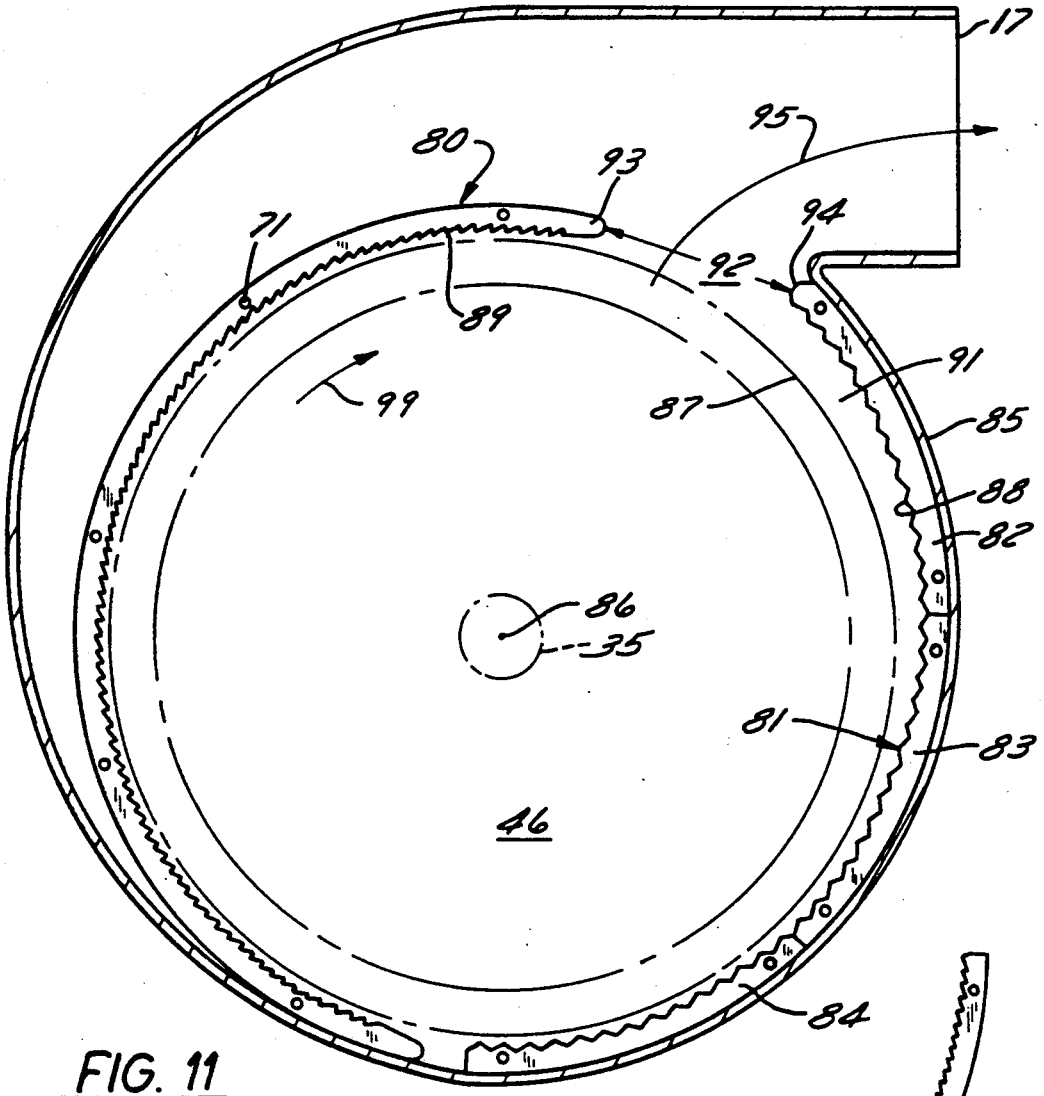
FIG. 11 is a vertical section through the fiberizer mill taken on a line corresponding with 11—11 in FIG. 2.

The previously mentioned substantially circular toothed breaker plate means which partially encircle the conical rotary disk appear in dashed lines in FIG. 1 and are comprised of two arcuate segments generally designated by the numerals 80 and 81. The profile of the breaker plate segments 80 and 81 may be seen more clearly in FIG. 11. The segments have threaded holes 71 in their sides as shown in FIG. 11 for securing them between the front and rear housing walls 11 and 12 with machine screws 72 as can be seen in FIG. 2. The breaker plates span the entire distance between the housing walls so there is no edge leakage. There is a coarse tooth breaker plate 81 arranged adjacent the involute shaped part of the wall of housing 10. Breaker plate 81 is made in three sections 82, 83 and 84 although it could be made in a single section. The housing section 85 has a partial involute configuration as shown in FIG. 11 which makes using the three segments preferable to facilitate a fit. However, as explained earlier, the breaker plate means and other components of the new and improved disk mill can be retrofitted in the same housing of the predecessor mill depicted in the heretofore cited Canadian patent. Half of the total circumference of the breaker plate means has relatively coarse teeth 88 projecting radially inwardly of the housing and the other half has finer teeth 89. These teeth extend across the entire width of the breaker plates or, in other words, they span across the interior of the housing between the front wall 11 and the rear wall 12.

Figure 12:
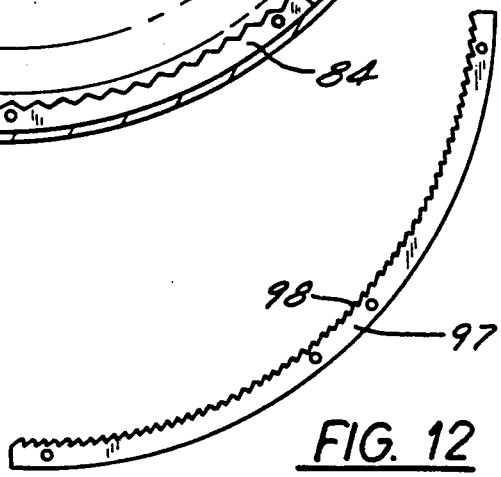
FIG. 12 is a side view of a modified toothed breaker plate section which can be substituted for part of the breaker plate shown in FIG. 11.

In another model of the new disk mill, the two coarse tooth breaker plate segments 83 and 84 are replaced by a single segment which is marked 97 and is depicted in FIG. 12. The segment 97 has the finer serrations 98 which are the same as the fine serrations 89 on breaker plate 80. The pitch of the fine serrations is 0.25 inch (6.35 mm) in this and the preceding embodiment by way of example and not limitation. Note that the sides of the fine serrations on breaker plates 80 in FIG. 11 and 97 in FIG. 12 which face the oncoming rotating hammers 56 are radially directed. That is, the sides of the serrations are coincident with radii emanating from the center of rotation 86 in FIG. 6. The same would be true of the teeth 98 of serrated segment 97 in FIG. 12 if it were installed in place of segments 83 and 84 in FIG. 11. The rotation direction of rotary conical disk 46 and hammers 56 thereon is indicated by the arrow 99.

The finer teeth 89 and 98 of the breaker plate members 80 and 97 in FIG. 11 have one side facing in a direction opposite of the direction in which the rotary disk rotates and another side slanted in the direction of rotation. The one sides of the teeth lie on radii extending from the axis of rotation 86 of the shaft 35. The advantage of having the one sides of the teeth radially oriented is that a tangent to the circle 87 of hammer rotation is perpendicular to said one sides and, hence, the particles are inclined to land perpendicularly to the one sides. This assures that the particles strike the one sides of the teeth with maximum obtainable force as the particles are impelled by centrifugal force and by the powerful radially flowing air stream induced in the housing.

One may see in FIG. 11 that the circular dashed line 87 which is traced by the hammer or wipers 60 on the rotary disk runs very close to the tips of the teeth 89 in the breaker plate 80 over its entire length. On the other hand, the circularly tapered gap 91 between the circle 87 traced by the wipers provides for easy admission of the larger pieces of hard pulp and there is greater space between the path of the wipers and coarse teeth 88. The tapered gap 91 is important because it brings about compression of the air in the gap as the air is forced along the diminishing size of the gap. The air pressure increase results in increasing air velocity along the teeth which is beneficial. By way of example and not limitation, in a model wherein the rotary disk is about 22" (56 cm) in diameter, there is a gap of about 0.25 of an inch (6.4 mm) between the hammers or wipers in the truly circular parts of breaker plate 80 whose extremities follow the dashed circular line 87 and the tips of the fine teeth or serrations on 89 on the breaker plate 80.

Note in FIG. 11 that there is a gap 92 between the trailing end 93 of breaker plate 80 and the leading end 94 of the breaker plate 81. Gap 92 provides for fibers which are centrifuged and blown radially outwardly along the face of the toothed stationary negative conical surface to pass to the outlet 17 of the housing along the path defined by arrowheaded line 95.

It is desirable to recognize the advantages of the structure defined above. The advantages can be most conveniently described in reference to FIG. 2. When a sheet of pulp is fed through gap 18 in front of housing wall 11 its leading end runs into the teeth 51 on the cutter bars 48 that are mounted on the rotary conical disk 46. This results in fragments of the pulp being nibbled or broken off and initiates fiberization. The initial bites are taken at a point where the radius of rotation is relatively short so that the linear speed of the teeth 51 on the rotary disk 46 is comparatively slower than the maximum linear speed of the rotary disk. Nevertheless, there is a strong flow of air in the typically about 0.1 inch gap between the serrations 70 on the stationary cone and the square teeth on the rotary cone as well as along the face of the rotary disk 46. This impels the pulp fragments and fibers to flow along the gap between the mating stationary and rotary conical disks as the fragments become finer. Because of the angulation of the rotary cone 46, a horizontal component of motion is induced in the particles which causes them to be driven or impacted and exploded on the radially directed sides of the multiplicity of concentric teeth 70 on the face 68 of the stationary disk 65. The particles pass through the radial outside extremity of the stationary disk 65 whereupon the particles and the fibers and air in which they are entrained are expelled radially outwardly against and toward the protruding teeth on the curved breaker plates 80 and 81. At this time, the particles are swept circularly along the serrated or toothed faces of the breaker plates to continue the process of smashing or impacting the particles into the sides of the teeth on the breaker plates. There is no place for the particles to go other than radially outwardly along the stationary and rotary disks during the first stage of pulp particle disintegration so the particles can not escape being impacted. After the particles are expelled from between the disks, there is no place for them to go other than to be swept around along the toothed surfaces of breaker plates. All of the particles are subjected to being impacted against the sides of the numerous fine teeth 89 on the breaker plate means 80 before they are able to arrive at the exit gap 92 between the ends 93 and 94 of the breaker plates and as a result of riding in the air blast, they exit through outlet 17 as indicated by the arrow marked 95.

I claim:

1. A disk mill for breaking pulp into fibers comprising:

a housing including spaced apart opposite walls, one of the walls having a slot for feeding pulp sheets into the housing and a rotationally driven shaft extending through the opposite wall into the housing, a curved breaker plate member arranged in the housing generally concentric to the axis of the shaft and radially spaced from the shaft, the curved radially inwardly presented sides of the breaker plate member having teeth, said breaker plate member extending axially across the space between the walls of the housing, the breaker plate member having a gap for fibers produced within the breaker plate member to flow to an outlet in the housing, a stationary disk mounted adjacent one wall in the housing, the disk having a slot aligned with said slot in the wall for allowing the leading edge of a sheet of pulp to enter the housing, the disk having a conical face presented inwardly of the housing and having a plurality of concentric serrations on said face, a rotary disk mounted to said shaft, said rotary disk having a direction of rotation and a conical face that is complementary in shape to the conical face of said stationary disk and is positioned adjacent said conical face of the stationary disk, a plurality of angularly spaced apart radially extending rows of teeth on said conical face of the rotary disk, said teeth in the rows projecting axially of the disk in close proximity to but in nonintermeshed fashion with the serrations on said stationary disk to provide for pulp particles that result from the pulp sheet fed through said slot in the stationary disk being engaged by rows of teeth to be driven against said serrations for causing the pulp to break into fibers as the pulp and fibers are advanced radially along said serrated face of the stationary disk, and hammer members extending radially from said rotary disk for sweeping past said teeth on the breaker plate member to further break up pulp that is discharged from between said disks.

2. The disk mill according to claim 1 wherein said conical face of the stationary disk is a recessed conical face and said conical face of said rotary disk with said radially extending rows of teeth thereon fits into the recess in complimentary fashion.

3. The disk mill according to claim 1 wherein the slot in said housing and the aligned slot in the stationary disk provide for feeding a pulp sheet into said housing for its leading end to be engaged and nibbled by said rows of teeth on said rotary disk, the slot in the disk coinciding with a chord traced across the stationary disk.

4. The disk mill according to claim 1 wherein said breaker plate member is comprised of first and second curved sections arranged consecutively in said housing, the first section having a leading end relative to the direction in which the disk rotates defining one boundary of said gap in the breaker plates, and said first section having a trailing end, the second section having a leading end adjacent said trailing end of the first section and said second section having a trailing end defining another boundary of said gap in the breaker plate member.

5. The disk mill according to claim 4 wherein said gap intercepts an arc of about 30 degrees.

6. The disk mill according to any one of claims 1 to 5 including an air inlet opening in said housing aligned with said shaft

7. The disk mill according to claim 4 wherein said breaker plate sections are substantially semi-circular.

8. The disk mill according to claim 1 wherein said curved breaker plate member intercepts an arc of about 380 degrees.

9. The disk mill according to claim 1 including a wall bridging between the opposite walls to define an enclosure, at least one of said opposite walls having an air intake opening in substantial alignment with said shaft.

10. The disk mill according to claim 1 wherein the conical face of the stationary disk is defined by a line at a predetermined angle relative to a plane that is perpendicular to the axis of the disk, said serrations on the stationary disk having one side that faces radially inwardly of the disk and another slanted side that faces radially outwardly of the disk, and said one side is substantially perpendicular to said line.

11. The disk mill according to claim 10 wherein said predetermined angle is about 17 degrees.

12. The disk mill according to claim 1 wherein at least a circumferentially extending part of said breaker plate member has teeth whose pitch is smaller than the pitch of the teeth on another part of said breaker plate having one side presented in a direction opposed to the direction of rotation of said rotary disk, said one side of the teeth lying on radii extending from the axis of rotation of the shaft for the rotary disk.

* * * * *